US006004400A

United States Patent [19]

Bishop et al.

[11] Patent Number: 6,004,400

[45] Date of Patent: Dec. 21, 1999

[54] CARBON DIOXIDE CLEANING PROCESS

[75] Inventors: Phillip W. Bishop, 1433 E. Butler Cir., Chandler, Ariz. 85225; Alexander J. Harrover, Tempe, Ariz.

[73] Assignee: Phillip W. Bishop, Chandler, Ariz.

[21] Appl. No.: 08/890,116

[22] Filed: Jul. 9, 1997

[51] Int. Cl.[6] ..... B08B 7/00

[52] U.S. Cl. ..... 134/2; 134/1.3; 134/6; 134/7; 134/26; 134/40; 134/902; 451/38; 451/39; 451/75; 451/102

[58] Field of Search ..... 451/38, 39, 75, 451/102; 134/1.3, 26, 2, 6, 7, 902, 40

[56] References Cited

U.S. PATENT DOCUMENTS

| | | | |
|---|---|---|---|
| 4,748,817 | 6/1988 | Oura et al. | 62/74 |
| 4,932,168 | 6/1990 | Tada et al. | 51/436 |
| 4,974,375 | 12/1990 | Tada et al. | 51/413 |
| 5,044,129 | 9/1991 | Olevitch | 51/322 |
| 5,125,979 | 6/1992 | Swain et al. | 134/7 |
| 5,308,404 | 5/1994 | Yam et al. | 134/7 |
| 5,318,636 | 6/1994 | Szucs | 134/7 |
| 5,593,339 | 1/1997 | Yam et al. | 451/36 |

*Primary Examiner*—Jill Warden
*Assistant Examiner*—Sharidan Carrillo
*Attorney, Agent, or Firm*—Tod R. Nissle, P.C.

[57] ABSTRACT

A method for cleaning parts employed during the processing of semiconductor wafers includes a first cleaning step for removing super-micron particles and a second cleaning step for removing sub-micron particles. The second step utilizes frozen carbon dioxide pellets and removes contaminant particles have a size of less than one micron. The cleaning method consistently removes substantially all sub-micron particles from a work surface.

14 Claims, 1 Drawing Sheet

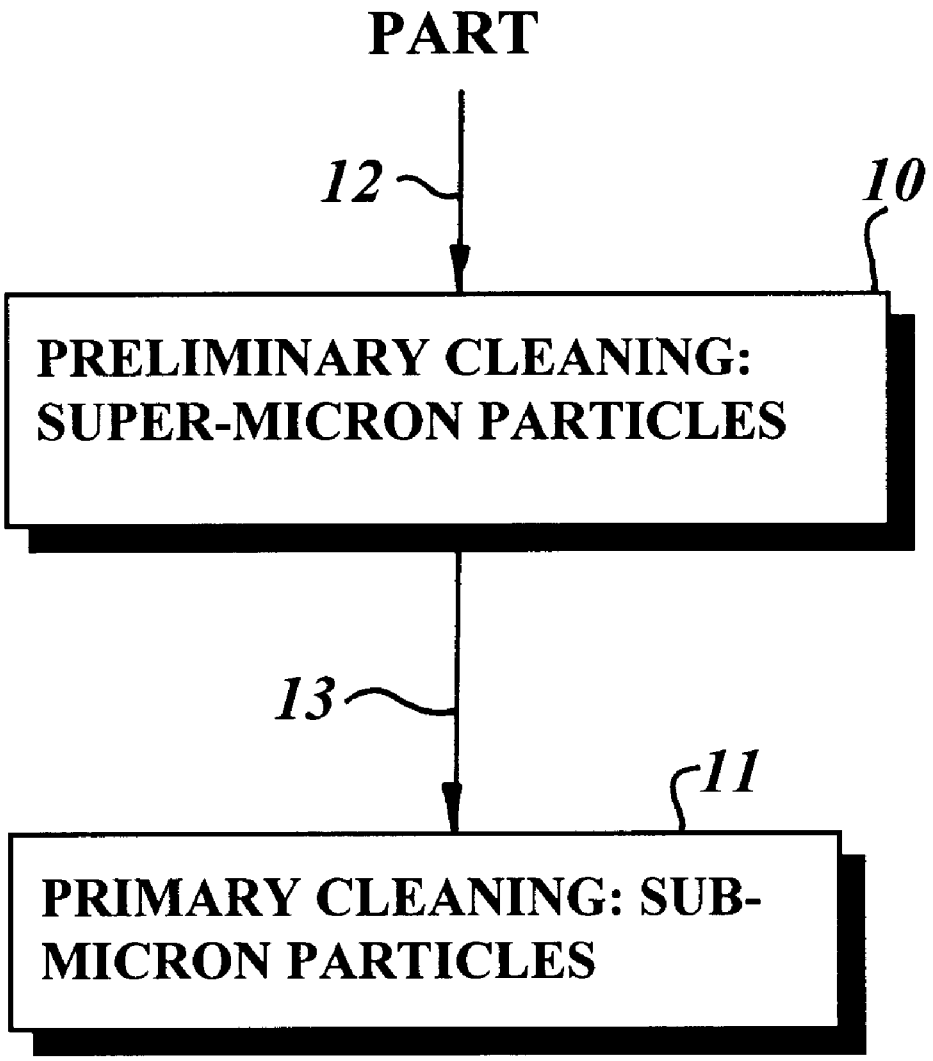
PART
12
10
PRELIMINARY CLEANING: SUPER-MICRON PARTICLES
13
11
PRIMARY CLEANING: SUB-MICRON PARTICLES

CARBON DIOXIDE CLEANING PROCESS

BACKGROUND OF THE INVENTION

1. Field of the Invention

This invention relates to a method and apparatus for cleaning parts which are components of semiconductor processing equipment and which include surfaces that are directly exposed to the atmosphere in the equipment, which atmosphere extends around a semiconductor wafer or other semiconductor part being processed in the equipment.

More particularly, the invention relates to a method and apparatus for removing both super-micron and sub-micron contaminant particles from the surface of a part from a semiconductor processing apparatus.

In a further respect, the invention relates to a method and apparatus particularly suited to cleaning ceramic parts from a semiconductor processing apparatus.

2. Description of the Prior Art

Equipment like the Lam Research Corporation (LRC) etcher (hereafter "LRC etcher") is widely used in the processing of semiconductor wafers. After a photolithographic pattern is formed or deposited on a semiconductor wafer, the wafer is loaded into an LRC etcher. The LRC etcher utilizes a plasma etching process to remove portions of the wafer which are not protected by the photolithographic pattern. The LRC etcher can be utilized as an oxide etcher, metal etcher, polymer etcher, etc. Such etching of the wafer causes particles of silicon oxide, nitride, arsenic oxide, tungsten oxide, aluminum oxide, titanium, ammonium chloride, chlorine based compounds, and other contaminant materials to be deposited on the surface of parts or components of the LRC etcher which are exposed to the atmosphere surrounding the wafer while the wafer is etched. Since such contaminants can adversely affect the processing of future wafers processed by the LRC etcher, contaminant particles must be carefully cleaned from the surfaces of parts in the LRC etcher, or in other equipment utilized to process semiconductor wafers or components.

One disadvantage of conventional processes of removing contaminant particles from parts used in an LRC etcher or other semiconductor processing equipment is that such processes do not remove most sub-micron particles from the surface of a part, particularly sub-micron particles which have a width of 0.5 to 0.2 micron or smaller. In prior years, the existence of such particles was not a major concern because the lines in the photolithographic patterns were larger and were spaced farther apart. It was only important to remove super-micron particles (i.e., particles with a width equal to or greater than one micron). With time, photolithographic patterns have become finer. The lines are narrower and are spaced closer together. As a result, the ability to remove sub-micron particles (i.e., particles having a width of less than one micron) has become critical. A variety of companies have, since about 1992, been working on the development of equipment for removing sub-micron contaminant particles from the surface of parts found in semiconductor processing equipment. Although such research has significant commercial import, it appears that an economical, reliable, practical process for consistently repeatedly removing a substantial portion of sub-micron contaminant particles from parts in a semiconductor processing apparatus has not yet been developed.

Accordingly, it would be highly desirable to provide an improved method and apparatus for cleaning the surface of a part utilized in semiconductor processing equipment.

It would also be highly desirable to provide in improved method and apparatus for removing sub-micron particles from parts used in processing semiconductor materials.

Therefore, it is a principal object of the instant invention to provide an improved cleaning method and apparatus for parts from semiconductor processing equipment.

Another object of the invention is to provide an improved cleaning method and apparatus for removing contaminant particles from parts having a surface comprised of a ceramic.

A further object of the invention is to provide an improved cleaning method and apparatus for removing sub-micron particles from the surface of a part utilized in processing semiconductor processing equipment.

BRIEF DESCRIPTION OF THE DRAWINGS

These and other, further and more specific objects and advantages of the invention will be apparent to those skilled in the art from the following detailed description thereof, taken in conjunction with the drawing which illustrates the cleaning of a part in accordance with the principles of the invention.

SUMMARY OF THE INVENTION

Briefly, in accordance with my invention, I provide improved apparatus for cleaning contaminant particles from the surface of a part which is a component of semiconductor processing equipment. The apparatus includes preliminary cleaning equipment including apparatus for removing super-micron contaminant particles from the surface by applying to the surface hard beads under pressure; and, primary cleaning equipment including apparatus for removing sub-micron contaminant particles from the surface by applying under pressure frozen carbon dioxide pellets to the surface.

In another embodiment of the invention, I provide improved apparatus for cleaning contaminant particles from the surface of a part which is a component of semiconductor processing equipment. The apparatus includes preliminary cleaning equipment including apparatus for removing super-micron contaminant particles from the surface by scrubbing the surface with strands of material including abrasive particles; and, primary cleaning equipment including apparatus for cleaning sub-micron contaminant particles from the surface by applying under pressure frozen carbon dioxide pellets to the surface.

In a further embodiment of the invention, I provide improved apparatus for cleaning contaminant particles from the surface of a part which is a component of semiconductor processing equipment. The improved apparatus includes preliminary cleaning equipment including apparatus for removing super-micron contaminant particles from the surface; and, primary cleaning equipment for removing sub-micron contaminant particles from the surface. The primary cleaning equipment includes a supply of frozen carbon dioxide pellets; apparatus for breaking at least a portion of the frozen carbon dioxide pellets to produce an aggregate of frozen carbon dioxide particles of differing size; and, apparatus for applying the pellets under pressure to the surface.

In still another embodiment of the invention, I provide an improved method for cleaning contaminant particles from the surface of a part which is a component of semiconductor processing equipment. The method includes the steps of preliminarily cleaning the semiconductor processing part; and, cleaning the preliminarily cleaned part with frozen carbon dioxide pellets.

In still a further embodiment of the invention, I provide an improved apparatus for cleaning contaminant particles from the surface of a metal part which is a component of semiconductor processing equipment. The apparatus includes preliminary cleaning equipment including apparatus for removing super-micron contaminant particles from the surface by applying to the surface hard beads at a pressure in the range of thirty to seventy psi at an impingement angle in the range of 30 to 60 degrees; and, primary cleaning equipment including apparatus for removing sub-micron contaminant particles from the surface by applying to the surface frozen carbon dioxide pellets at a pressure in the range of 50 to 100 pounds per square inch.

In yet another embodiment of the invention, I provide improved apparatus for cleaning contaminant particles from the surface of a ceramic part which is a component of semiconductor processing equipment and for reducing the number of contaminant particles on said part. The apparatus includes preliminary cleaning equipment including apparatus for cleaning the semiconductor processing part by applying hard beads to the part at a pressure in the range of twenty to thirty-five psi at an impingement angle in the range of 30 to 60 degrees; and, primary cleaning equipment including means for cleaning the semiconductor processing part by applying under pressure frozen carbon dioxide pellets to the part at a pressure in the range of 70 to 110 pounds per square inch.

In yet a further embodiment of the invention, I provide improved apparatus for cleaning contaminant particles from the surface of a metal part which is a component of semiconductor processing equipment. The apparatus includes preliminary cleaning equipment including apparatus for removing super-micron particles from the surface by applying hard beads to the surface at a pressure in the range of thirty to seventy psi at an impingement angle in the range of 30 to 60 degrees; and, primary cleaning equipment including apparatus for removing sub-micron particles from the surface by applying under pressure frozen carbon dioxide pellets to the part. The pellets have a width in the range of one-sixteenth to three-sixteenths of an inch and a length in the range of three-sixteenths to five-sixteenths of an inch.

In another embodiment of the invention, I provide improved apparatus for cleaning contaminant particles from the surface of a ceramic part which is a component of semiconductor processing equipment. The apparatus includes preliminary cleaning equipment including apparatus for removing super-micron contaminant particles from the surface by applying hard beads to the surface at a pressure in the range of twenty to thirty-five psi at an impingement angle in the range of 30 to 60 degrees; and, primary cleaning equipment including means for removing sub-micron particles from the surface by applying under pressure frozen carbon dioxide pellets to the surface. The pellets have a width in the range of one thirty-second to one-eighth of an inch.

In a further embodiment of the invention, I provide improved apparatus for cleaning contaminant particles from the surface of a metal part which is a component of semiconductor processing equipment. The apparatus includes preliminary cleaning equipment including means for removing super-micron particles from the surface by applying hard beads to the surface at a pressure in the range of thirty to seventy psi at an impingement angle in the range of 30 to 60 degrees; and, primary cleaning equipment including apparatus for removing sub-micron particles from the surface by applying under pressure a mixture of a gas and frozen carbon dioxide pellets to the surface. The pellets comprise from ten percent to fifty percent by volume of said mixture.

In still another embodiment of the invention, I provide improved apparatus for removing contaminant particles from the surface of a ceramic part which is a component of semiconductor processing equipment. The apparatus includes preliminary cleaning equipment including apparatus for removing super-micron particles from the surface by applying hard beads to the surface at a pressure in the range of twenty to thirty-five psi at an impingement angle in the range of 30 to 60 degrees; and, primary cleaning equipment including means for cleaning the surface by applying under pressure a mixture of a gas and frozen carbon dioxide pellets to the surface. The pellets comprise five to twenty-five percent by volume of the mixture.

In still a further embodiment of the invention, I provide improved apparatus for cleaning contaminant particles from the surface of a metal part which is a component of semiconductor processing equipment. The apparatus includes preliminary cleaning equipment including apparatus for removing super-micron particles from the surface by applying hard beads to the surface at a pressure in the range of thirty to seventy psi at an impingement angle in the range of 30 to 60 degrees; and, primary cleaning equipment including apparatus for cleaning said surface by dispensing toward the surface from a nozzle frozen carbon dioxide pellets at a pressure in the range of 50 to 100 pounds per square inch; and, apparatus for positioning said nozzle two to four inches from said surface.

In yet another embodiment of the invention, I provide improved apparatus for cleaning contaminant particles from the surface of a ceramic part which is a component of semiconductor processing equipment. The apparatus includes preliminary cleaning equipment including apparatus for removing super-micron particles from the surface by applying hard beads to the surface at a pressure in the range of twenty to thirty-five psi at an impingement angle in the range of 30 to 60 degrees; and, primary cleaning equipment including apparatus for removing sub-micron particles from said surface by dispensing toward the surface from a nozzle frozen carbon dioxide pellets at a pressure in the range of 50 to 100 pounds per square inch; and, apparatus for positioning the nozzle six to eight inches from said surface.

In yet a further embodiment of the invention, I provide an improved method for cleaning contaminant particles from the surface of a part which is a component of semiconductor processing equipment. The method includes the steps of preliminarily cleaning the surface to remove substantially all super-micron particles; and cleaning the preliminarily cleaned surface with frozen carbon dioxide pellets under pressure to remove sub-micron particles therefrom by fracking.

DESCRIPTION OF THE PREFERRED EMBODIMENTS

Turning now to the drawing which depicts the presently preferred embodiment of the invention for the purpose of describing the operation thereof and not by way of limitation of the scope of the invention, FIG. 1 illustrates the cleaning of a part from semiconductor processing equipment. The part is first directed 12 into apparatus 10 for preliminarily cleaning the surface of the part to remove super-micron particles. The part is then directed 13 into apparatus 11 for primarily cleaning the part to remove sub-micron particles from the surface of the part.

Although in some instances, the preliminary cleaning 10 of a part can be dispensed with and the part can be given only a primary cleaning 11, in the large majority of cases, the preliminary cleaning is critical in the practice of the invention. The preliminary cleaning ordinarily is accomplished either by impinging or "blasting" glass, aluminum oxide, silicon carbide, titanium oxide, walnut shell particles, or other hard beads against the part being cleaned. The beads ordinarily are carried in a pressurized stream of air or other gas, although in some instances it might be possible to transport the beads in a stream of liquid. Preliminary cleaning is also accomplished by utilizing Scotch Brite™ pads or some other fabric material including strands or filaments. The fabric strands can be loosely woven, like yarn; can be tightly woven; or, can be otherwise agglomerated, as the a felt pad. The fabric can be impregnated or coated with aluminum oxide or other abrasive particles. A solid rubber or polymer pad can also be utilized to clean the surface of a part. The polymer can be impregnated or coated with abrasive particles. The function of preliminary cleaning is to remove substantially all super-micron particles from the surface of the part. After preliminary cleaning is concluded, the part is typically rinsed with deionized water.

When hard beads are utilized, the beads can be spherical, granular, have edges, have only smooth arcuate surfaces without edges, or have any other desired shape and dimension. It is important that the beads be impinged at an angle in the range of 30 to 60 degrees against the surface being cleaned. Directing the beads against the surface along a path which is normal to the surface is avoided. The utilization of a pressurized stream of beads is important not only to remove super-micron particles, but also to work harden and, if the beads have edges, to score contaminant particles to facilitate removal of the particles by subsequent fracking with carbon dioxide particles.

The pressure under which beads are directed toward the surface of a part depends on the composition of the part. Beads leave the nozzle of a pneumatic hose at a pressure in the range of 20 to 35 psi when a ceramic part is being cleaned. When the part is made from stainless steel or aluminum, beads leave the nozzle of a pneumatic hose at a pressure in the range of 30 psi to 50 psi, although in the case of stainless steel, pressures in the range of 30 psi to 70 psi can be employed. The side of the beads utilized can vary as desired. By way of example, 120 grit aluminum oxide can be utilized on ceramic parts. The pressure ranges I have discovered are important because they optimize the removal of contaminant particles and reduce the risk that the part being cleaned will be damaged.

During preliminary pneumatic cleaning with beads, each point on the surface of the part being cleaned is normally cleaned for about one to ten seconds, preferably three to six seconds. In the majority of cases, cleaning an area on a surface for this period of time is sufficient to remove substantially all super-micron particles.

When preliminary cleaning is performed with a fabric or polymer material, it is preferred that the fabric or polymer material include abrasive particles which score or work harden contaminant particles may remain on the surface of the part after preliminary cleaning is accomplished. Such scoring and work hardening facilitate removal of the contaminant particles by fracking.

Although the preliminary cleaning is important to properly prepare the surface for the next cleaning phase, the preliminary cleaning ordinarily will not remove a substantial quantity of sub-micron contaminant particles from the surface being cleaned. Rather, preliminary cleaning prepares the surface and remaining contaminant particles for the primary cleaning process necessary to remove sub-micron particles such that substantially all or most contaminant particles are removed from the surface of the part.

The primary cleaning 11 consists of directing under pressure a stream of frozen carbon dioxide pellets against the surface of a part which has been the preliminarily cleaned. The size of the carbon dioxide pellet, pressure, and other factors vary depending on the composition of the material being cleaned.

For a ceramic, the width and length of each carbon dioxide pellet is usually (although not necessarily) in the range of one-sixteenth to three-sixteenths of an inch, and, the pellets leave the nozzle of a pneumatic hose at a pressure in the range of 70 to 110 psi. The nose of the nozzle presently is typically optimally maintained at a distance of six to eight inches from the surface being cleaned, although in some circumstances this distance can be varied. When teflon is being cleaned, the carbon dioxide pellets preferably have a diameter or width of about 0.070 to 0.090 inch.

For stainless steel, aluminum, or another metal, the width of each carbon dioxide pellet is typically (although not necessarily) in the range of one-sixteenth to three-sixteenths of an inch, the length is in the range of one-eighth to five-eighths of an inch, and, the pellets exit the nozzle of a pneumatic hose at a pressure in the range of 70 to 100 psi. The nose or distal end of the nozzle presently is typically maintained at a distance of two to four inches from the surface being cleaned, although in some circumstances this distance can be varied.

The proportion of carbon dioxide ice pellets in the air stream directed toward the surface of a part being cleaned is also important. If the proportion of ice is too great, then pellets hit pellets and transfer kinetic energy from one to the other instead of to the surface being cleaned. If there are too few pellets, contaminate particles are not properly frozen and embrittled. The carbon dioxide ice particle stream ideally functions to frackle (i.e., freeze and crack) contaminate particles. When ceramic parts are being cleaned the air—pellet stream dispensed from the nozzle of a hose is typically 10% to 30% carbon dioxide pellets by volume. When stainless steel, aluminum, or other metal parts are being cleaned, the air—pellet stream dispensed from the nozzle of a hose is typically 25% to 50% by volume carbon dioxide ice pellets.

I have also discovered that producing an aggregate of carbon dioxide particles of differing size facilitates cleaning of the surface of a part. One preferred method of producing such an aggregate is accomplished while the pellets travel to the part. The pellets travel through a hose with a rough corrugated inner surface. The inner surface of the hose presently preferred comprises a helically wrapped piece of flex steel. The hose has a length in the range of ten to twenty feet, although such length can be varied as desired. The helically wrapped steel produces an inner surface having corrugations which are about 0.010 to 0.020 thousandths high. When carbon dioxide ice pellets travel through the hose to the dispensing nozzle, some of the pellets hit the corrugations and break into smaller pellets. Presently, when the hose is about fourteen feet long, about one-half of the pellets which emerge from the nozzle are the same size as when they originally entered the hose. Approximately the remaining half of the carbon dioxide pellets are smaller and have a width in the range of about one-half the original width down to about 0.005 of an inch. Dispensing a carbon dioxide ice pellet mixture having such an aggregate of different sized particles appears to increase the efficiency of the primary cleaning apparatus of the invention by about 10% to 25%.

During primary pneumatic cleaning with carbon dioxide ice pellets, each point on the surface of the part being cleaned is normally impinged with pellets for about one to ten seconds, preferably three to six seconds. In the majority of cases, cleaning an area on a surface for this period of time is sufficient to remove substantially all sub-micron contaminant particles, along with most of the remaining super-micron contaminant particles.

The nozzle used to pneumatically dispense carbon dioxide ice pellets in accordance with the invention has an opening in the range of three-eighths to one and one-quarter inches.

Having described my invention in such terms as to enable those skilled in the art to make and practice the invention.

We claim:

1. A method for cleaning contaminant particles from a surface of a metal part which is a component of semiconductor processing equipment, said contaminant particles being comprised of at least one of the group consisting of silicon oxide, a nitride, arsenic oxide, tungsten oxide, aluminum oxide, titanium, and ammonium chloride, said method including the steps of (a) preliminarily cleaning said surface with an abrasive material to
  (i) remove substantially all super-micron particles,
  (ii) remove a portion of sub-micron particles from said surface, and
  (iii) work harden at least a portion of sub-micron particles which remain on said surface after said surface is preliminarily cleaned;

(b) cleaning said preliminarily cleaned surface with frozen carbon dioxide pellets under pressure to
  (i) freeze and crack said sub-micron particles which remain on said surface, and
  (ii) remove substantially all of said sub-micron particles from said surface;

said frozen carbon dioxide pellets having a width in the range of one-sixteenth to three-sixteenths of an inch and a length in the range of three-sixteenths to five-sixteenths of an inch.

2. The method of claim 1 wherein (a) in step (a) of claim 1 a pneumatic stream of beads is directed against said surface to accomplish said preliminarily cleaning; and, (b) in step (b) of claim 1 said carbon dioxide pellets are directed against said surface in an air stream such that the volume percent of said pellets in said air stream is in the range of 25% to 50% by volume.

3. The method of claim 1 wherein in step (b) of claim 1 said carbon dioxide pellets are directed against said surface in an air stream exiting a nozzle under a pressure in the range of 70 to 100 psi and at a distance from said surface in the range of two to four inches.

4. The method of claim 1 wherein in step (a) of claim 1 at least a portion of of the sub-micron particles remaining on said surface are scored during said preliminarily cleaning.

5. The method of claim 1 wherein said abrasive material is a pad.

6. The method of claim 5 wherein said pad includes fabric material.

7. The method of claim 5 wherein in step (a) said pad scores at least a portion of the sub-micron particles remaining on said surface after said preliminarily cleaning is completed.

8. A method for cleaning contaminant particles from a surface of a part which is a component of semiconductor processing equipment, said contaminant particles being comprised of at least one of the group consisting of silicon oxide, a nitride, arsenic oxide, tungsten oxide, aluminum oxide, titanium, and ammonium chloride, said method including the steps of (a) preliminarily cleaning said surface with an abrasive material to
  (i) remove substantially all super-micron particles,
  (ii) remove a portion of sub-micron particles from said surface, and
  (iii) work harden at least a portion of sub-micron particles which remain on said surface after said surface is preliminarily cleaned;

(b) pneumatically directing a stream of original frozen carbon dioxide pellets, each pellet having a width in the range of one sixteenth of an inch to three sixteenths of an inch, wherein said stream is directed under pressure through a hose having a distal end an inner surface and through a nozzle attached to said distal end and against said preliminarily cleaned surface to
  (i) freeze and crack said sub-micron particles which remain on said surface, and
  (ii) remove substantially all of said sub-micron particles from said surface, the inner surface of said hose being shaped and dimensioned to break a first portion of said original carbon dioxide pellets into smaller pieces to form pellet fragments less than about one-half the size of said original pellets such that said carbon dioxide pellets exiting said nozzle and contacting said preliminarily cleaned surface comprise an aggregate including a second portion of said original pellets and including said pellet fragments formed from said first portion.

9. The method of claim 8 wherein said abrasive material is impregnated in a pad.

10. The method of claim 8 wherein said carbon dioxide pellets have a length in the range of three-sixteenths to five-sixteenths of an inch.

11. A method for cleaning contaminant particles from a surface of a ceramic part which is a component of semiconductor processing equipment, said contaminant particles being comprised of at least one of the group consisting of silicon oxide, a nitride, arsenic oxide, tungsten oxide, aluminum oxide, titanium, and ammonium chloride, said method including the steps of (a) preliminarily cleaning said surface with an abrasive material to
  (i) remove substantially all super-micron particles,
  (ii) remove a portion of sub-micron particles from said surface, and
  (iii) work harden at least a portion of sub-micron particles which remain on said surface after said surface is preliminarily cleaned;

(b) cleaning said preliminarily cleaned surface with frozen carbon dioxide pellets under pressure to
  (i) freeze and crack said sub-micron particles which remain on said surface, and
  (ii) remove substantially all of said sub-micron particles from said surface;

said frozen carbon dioxide pellets having a width in the range of one-thirty-second to one-eighth of an inch.

12. The method of claim 11 wherein (a) in step (a) of claim 11 a pneumatic stream of beads is directed against said surface to accomplish said preliminarily cleaning; and, (b) in step (b) of claim 11 said carbon dioxide pellets are directed against said surface in an air stream such that the percentage of said pellets in said air stream is in the range of 10% to 30% by volume.

13. The method of claim 11 wherein in step (b) of claim 11 said carbon dioxide pellets are directed against said surface in an air stream exiting a nozzle under a pressure in the range of 70 to 110 psi and at a distance from said surface in the range of six to eight inches.

14. The method of claim 11 wherein in step (a) at least a portion of the sub-micron particles which remain on said surface are scored during said preliminarily cleaning.

* * * * *